US005756969A

United States Patent [19]

Machino et al.

[11] Patent Number: 5,756,969

[45] Date of Patent: May 26, 1998

[54] HEATING CONTROL APPARATUS

[75] Inventors: Hitoshi Machino, Tokyo; Kiyoto Toyoizumi, Odawara; Masayoshi Takahashi, Numazu, all of Japan

[73] Assignee: Canon Kabushiki Kaisha, Tokyo, Japan

[21] Appl. No.: 739,963

[22] Filed: Oct. 30, 1996

[30] Foreign Application Priority Data

Nov. 2, 1995 [JP] Japan ..... 7-285778

[51] Int. Cl.[6] ..... H05B 1/02

[52] U.S. Cl. ..... 219/497; 219/216; 219/481; 219/501

[58] Field of Search ..... 219/216, 481, 219/488, 501, 497, 505, 506, 508; 374/1–3; 307/117

[56] References Cited

U.S. PATENT DOCUMENTS 4,162,847 7/1979 Brandon ..... 355/14
4,626,663 12/1986 Tateda ..... 215/504
4,707,579 11/1987 Mckiel, Jr. ..... 219/56.22
4,740,671 4/1988 Kuroda et al. ..... 217/492
5,321,230 6/1994 Shanklin et al. ..... 219/492

*Primary Examiner*—Mark H. Paschall
*Attorney, Agent, or Firm*—Fitzpatrick, Cella, Harper & Scinto

[57] ABSTRACT

A heating control device of an image forming apparatus determines a phase of heat control in accordance with a target temperature and a current temperature of a fixing roller and a change status of the current temperature, determines a control unit period tp, a main heater turn-on time tm, a sub-heater turn-on time ts and Duty No. in accordance with a count of a counter which counts the number of control units which are unit periods of control and a shift status of phase, and finally determines a type of control and supplies powers to the main heater and the sub-heater.

A proper heater power to control to a target temperature can be applied in a short period and a temperature ripple is reduced.

5 Claims, 18 Drawing Sheets

| FIG. 11A | FIG. 11B |
|---|---|

FIG. 12A

| GROUP | GROUP 1 | | GROUP 2 | | GROUP 3 | | GROUP 4 | | TO | FROM |
|---|---|---|---|---|---|---|---|---|---|---|
| DUTY No. | MAIN | SUB | MAIN | SUB | MAIN | SUB | MAIN | SUB | GROUP 3 | GROUP 3 |
| 15 | 500ms | 500 | 500 | 250 | 500 | 100 | 500 | 0 | 14 | 13 |
| 14 | 480 | 480 | 480 | 240 | 480 | 90 | 480 | 0 | 14 | 13 |
| 13 | 460 | 460 | 460 | 230 | 450 | 90 | 460 | 0 | 14 | 10 |
| 12 | 440 | 440 | 440 | 220 | 430 | 80 | 440 | 0 | 12 | 10 |
| 11 | 420 | 420 | 420 | 210 | 400 | 80 | 420 | 0 | 12 | 7 |
| 10 | 400 | 400 | 400 | 200 | 380 | 70 | 400 | 0 | 12 | 7 |
| 9 | 380 | 380 | 380 | 190 | 350 | 70 | 380 | 0 | 10 | 4 |
| 8 | 360 | 360 | 360 | 180 | 330 | 60 | 360 | 0 | 10 | 4 |
| 7 | 340 | 340 | 340 | 170 | 300 | 60 | 340 | 0 | 10 | 1 |
| 6 | 320 | 320 | 320 | 160 | 280 | 50 | 320 | 0 | 8 | 1 |
| 5 | 300 | 300 | 300 | 150 | 250 | 50 | 300 | 0 | 8 | 0 |
| 4 | 280 | 280 | 280 | 140 | - | - | 280 | 0 | 8 | - |
| 3 | 260 | 260 | 260 | 130 | - | - | 260 | 0 | 6 | - |
| 2 | 240 | 240 | 240 | 120 | - | - | 240 | 0 | 6 | - |
| 1 | 220 | 220 | 220 | 110 | - | - | 220 | 0 | 6 | - |
| 0 | 200 | 200 | 200 | 100 | - | - | 200 | 0 | 5 | - |

tm, ts IN PRINT TEMPERATURE STEADY CONTROL

FIG. 12B

| GROUP | GROUP 1 | GROUP 2 | GROUP 3 | GROUP 4 | |
|---|---|---|---|---|---|
| SIZE | A3 - P<br>A4 - L | L - SIZE<br>LDR - P<br>LTR - L | M - SIZE<br>B4 - P | S - SIZE<br>LGL - P<br>LTR - P<br>A4 - P | SS - SIZE<br>EXE - P<br>B5 - P<br>A5 - P<br>ENVELOPE |
| TARGET TEMPERATURE | 190℃ | | | | 195℃ |

PAPER GROUP AND TARGET TEMPERATURE

FIG. 13

| PRESENT PHASE | PHASE L | PHASE R, F | PHASE H |
|---|---|---|---|
| targ_h< THERMISTOR TEMPERATURE | SHIFT TO PHASE H<br>COUNTER 203d←0; | SAME AS LEFT | COUNTER 203d<br>DECREMENT |
| targ_l< THERMISTOR TEMPERATURE≦targ_h | SHIFT TO PHASE R | NOT PROCESS | SHIFT TO PHASE F |
| THERMISTOR TEMPERATURE≦targ_l | COUNTER 203d<br>DECREMENT | SAME AS RIGHT | SHIFT TO PHASE L<br>COUNTER 203d←0; |

targ_h=TARGET TEMPERATURE+HYSTERESIS;
targ_l=TARGET TEMPERATURE;

FIG. 15

| PRESENT PHASE | PHASE L | PHASE R, F | PHASE H |
|---|---|---|---|
| targ_v< THERMISTOR TEMPERATURE | SHIFT TO PHASE H<br>COUNTER 203d←0; | SAME AS LEFT | NOT PROCESS |
| targ_h< THERMISTOR TEMPERATURE≦targ_v | SAME AS ABOVE | SAME AS ABOVE | COUNTER 203d DECREMENT |
| targ_l< THERMISTOR TEMPERATURE≦targ_h | SHIFT TO PHASE R | NOT PROCESS | SHIFT TO PHASE F |
| THERMISTOR TEMPERATURE≦targ_l | COUNTER 203d DECREMENT | SAME AS RIGHT | SHIFT TO PHASE L<br>COUNTER 203d←0; |

targ_v=TARGET TEMPERATURE+5℃;
targ_h=TARGET TEMPERATURE+HYSTERESIS;
targ_l=TARGET TEMPERATURE;

HEATING CONTROL APPARATUS

BACKGROUND OF THE INVENTION

1. Field of the Invention

The present invention relates to heating control of a thermal fixing unit of a printer.

2. Related Background Art

Prior art copying machine and laser printer are provided with fixing units including heating rollers for thermally fixing toners onto print sheets. For the temperature control of the heating roller, a roller temperature is detected to turn on and off the heating roller. In the prior art, a control method to turn on the heater when the heating is desired and turn off the heater when the heating is not desired has been used.

FIG. 18 shows a timing chart of the detection of a fault (break) in the prior art heating roller.

When the heater is on and an energization detection signal is not generated, a counter is incremented at a predetermined time interval. For example, when a counter 203*b* counts 0, 1, 2 and the count of the counter 203*b* reaches 2, a counter 203*c* counts 1, 2, 3. When the heater is next turned on, the counter 203*b* counts 0, 1, 2 and then the counter 203*c* counts 1, 2, 3, 4, and a fault is detected when the counter 203*c* counts 4. Namely, when the heater is on and the energization detection signal is not generated in the predetermined time period, a fault is detected. Even if the drive signal is turned from off to on, the energization signal is off for 10 to 20 msec. Accordingly, since the detection during this period makes no sense, the counter 203*b* counts the elapse during this period.

In the prior art, a signal line for the energization detection signal for detecting the fault (break) of the heating source (halogen heater) of the thermal fixing unit is provided. However, such prior art device has the following problems.

For example, with the tendency of high speed of a recent printer, a power capacity of the heater increases accordingly and the heating is attained quickly, but a temperature overshot when heating to a target temperature is large and a temperature ripple is large.

Further, when the heater is turned on at a short time interval in order to reduce an overall power consumption and when a fault is of a type which cannot be detected unless the fault lasts for a certain time period, the fault cannot be detected if the time period is shorter than the on-time of the heater, for example, if the heater is turned off before the count reaches 4 in FIG. 18.

In the prior art device, it is necessary to provide a signal line for each of a plurality of heating sources and a transmission path and an input port of a CPU (microcomputer) in a control unit are required for each of the heating sources. Thus, the complication of the circuit and the cost increase accordingly.

SUMMARY OF THE INVENTION

It is an object of the present invention to provide heating control device and heating control method which eliminate the above defects.

It is another object of the present invention to provide heating control device and heating control method which can minimize a temperature ripple in the heat control.

It is other object of the present invention to provide heating control device and heating control method which allow the detection of a fault of a heater even if a control method with a short energization period to the heater is adopted.

It is other object of the present invention to provide heating control device and heating control method which can transmit detection signals of respective heater status of a plurality of heaters with a small number of signal lines.

Other objects of the present invention will be apparent from the following description in connection with the accompanying drawings and the appended claims.

BRIEF DESCRIPTION OF THE DRAWINGS

FIGS. 12A and 12B illustrate data necessary for the variable heater turn-on duty control for each of sheet groups in the Embodiment 1 of the present invention.

FIG. 13 shows a process for each phase in the print temperature steady control in the Embodiment 1 of the present invention.

FIG. 15 shows a process for each phase in the print temperature steady control in the Embodiment 2 of the present invention.

DETAILED DESCRIPTION OF THE PREFERRED EMBODIMENTS

The embodiments of the present invention are now explained with reference to the drawings.

[Embodiment 1]

Figure 1:
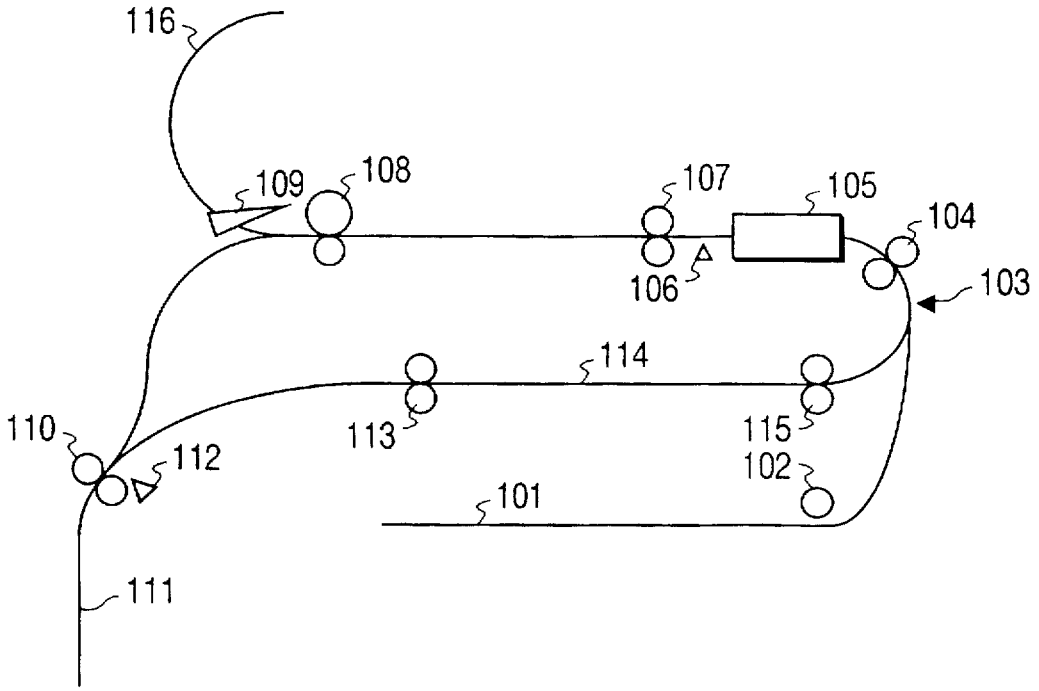
FIG. 1 illustrates a sheet feed path of a printer in accordance with the present invention.

FIG. 1 shows a sheet feed path of a printer having a heating control apparatus of the present invention. Numeral 101 denotes an internal cassette sheet feed path and numeral 102 denotes an internal cassette sheet feed roller. Numeral 103 denotes a feed sensor which detects the passage of a fed sheet. Numeral 104 denotes a feed roller which feeds the sheet toward a registration roller. Numeral 105 a movable lateral registration plate for the registration vertical to the feed direction (horizontal) and two such plates are provided to pinch the sheet from left and right. Numeral 106 denotes a pre-registration sensor for measuring a timing to form a loop before a registration roller pair 107. Numeral 108 denotes a fixing roller pair which also has a feed function, and numeral 109 denotes a flapper for selectively directing a sheet to a reversal mechanism or an ejection mechanism. Numeral 110 denotes a reversal roller which, when a trailing edge of the sheet is detected by a reversal sensor 112 during the feed of the sheet to a path 111, switches the sheet feed direction to the opposite direction to feed the sheet toward a reversal mechanism feed roller 113. The sheet fed to a reversal mechanism feed path 114 is fed again along the path succeeding to the feed sensor 103 by a re-feed roller 115 and it is now directed to an ejection path 116 by the flapper 109.

Figure 2A:
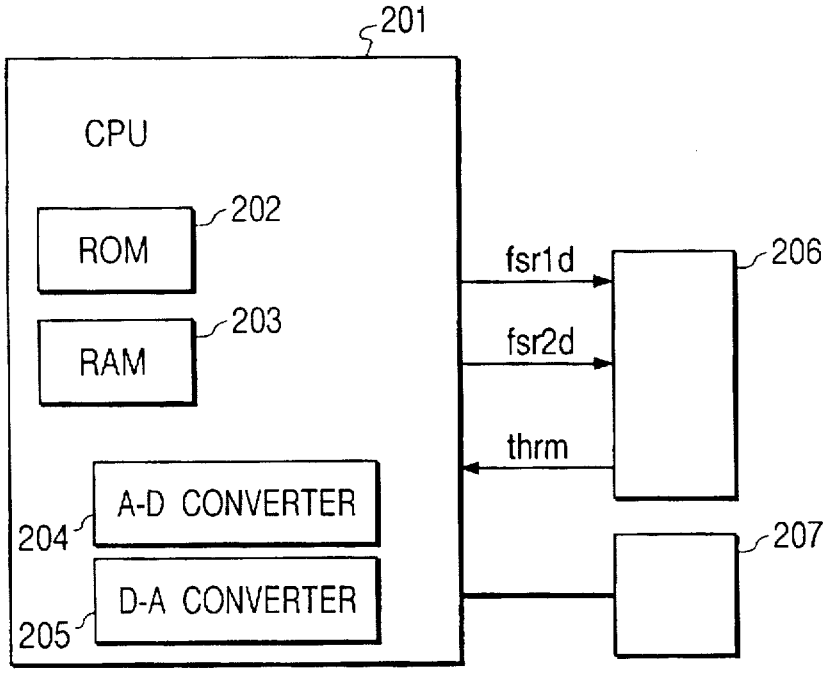
FIGS. 2A and 2B show block diagrams of a configuration of an electrical circuit of the printer in accordance with the present invention.
Figure 2B:
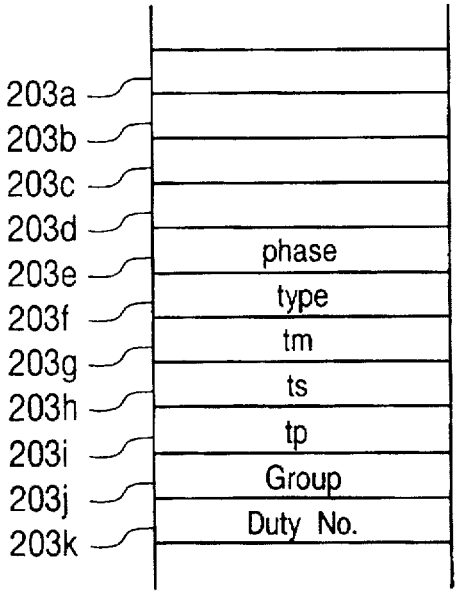

FIGS. 2A and 2B show block diagrams of a configuration of an electrical circuit which serves the control of the printer having the heating control device in accordance with the present invention.

Referring to FIG. 2A, numeral 201 denotes a CPU, numeral 202 denotes a ROM which stores a control program, numeral 203 denotes a working RAM, numeral 204 denotes an A/D converter to which an analog signal such as a fixing unit temperature is inputted, numeral 205 denotes a D/A converter for outputting an analog signal for controlling an external device and numeral 206 denotes a fixing heater drive circuit. Numeral 207 denotes other mechanism.

The fixing unit of the printer is operated in a thermal fixing system and the printer has two heaters, main and sub-heaters, which have heater drive signal lines fsr1*d* and fsr2*d*, respectively. Symbol thrm denotes an analog signal line for inputting a voltage division level between a thermistor which is a temperature sensor of the fixing unit and a predetermined resistor.

FIG. 2B shows a memory area of data relating to the present invention in the RAM 203.

The print temperature control in the present Embodiment 1 has a hysteresis. Thus, the temperature controlls conducted in the following four phases:

Phase L (Low: below a target temperature)

Phase R (Raise up: rising in the hysteresis)

Phase H (High: target temperature+hysteresis excess)

Phase F (Fall down: falling in the hysteresis)

Figure 9:
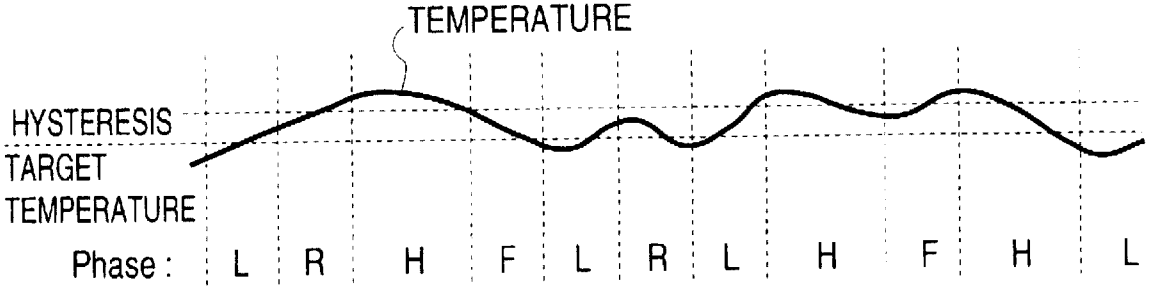
FIG. 9 shows a time chart illustrating a change in a phase of the fixing unit temperature control in an Embodiment 1 of the present invention.

Those four phases are settled for each control unit (a unit of time of the fixing heater control sectioned by a predetermined time period) and shifted in a manner shown in FIG. 9 and stored in 203*e* as "Phase" at the respective time points.

Figure 10A:
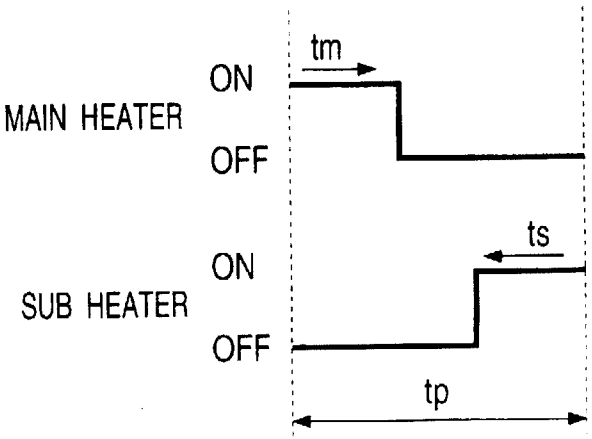
FIGS. 10A and 10B illustrate types of a control unit of the fixing unit temperature control in the Embodiment 1 of the present invention.
Figure 10B:
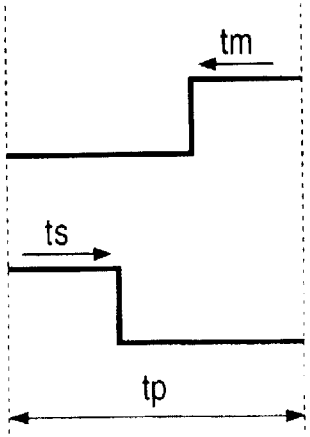

FIGS. 10A and 10B show two types of temperature control in the control unit, in which tp denotes a control unit period, tm denotes a main heater turn-on time and ts denotes a sub-heater turn-on time. In type 1, tm is set with reference to the beginning of the control unit and ts is set with reference to the end of the control unit. In type 2, tm is set with reference to the end of the control unit and ts is set with reference to the beginning of the control unit. One of the two types for the control is stored in the RAM 203*f* as "type".

Referring to FIGS. 11A, 11B, 12A, 12B, 13 and 14, a heater control process in the present embodiment is explained.

Figures 11, 11A:
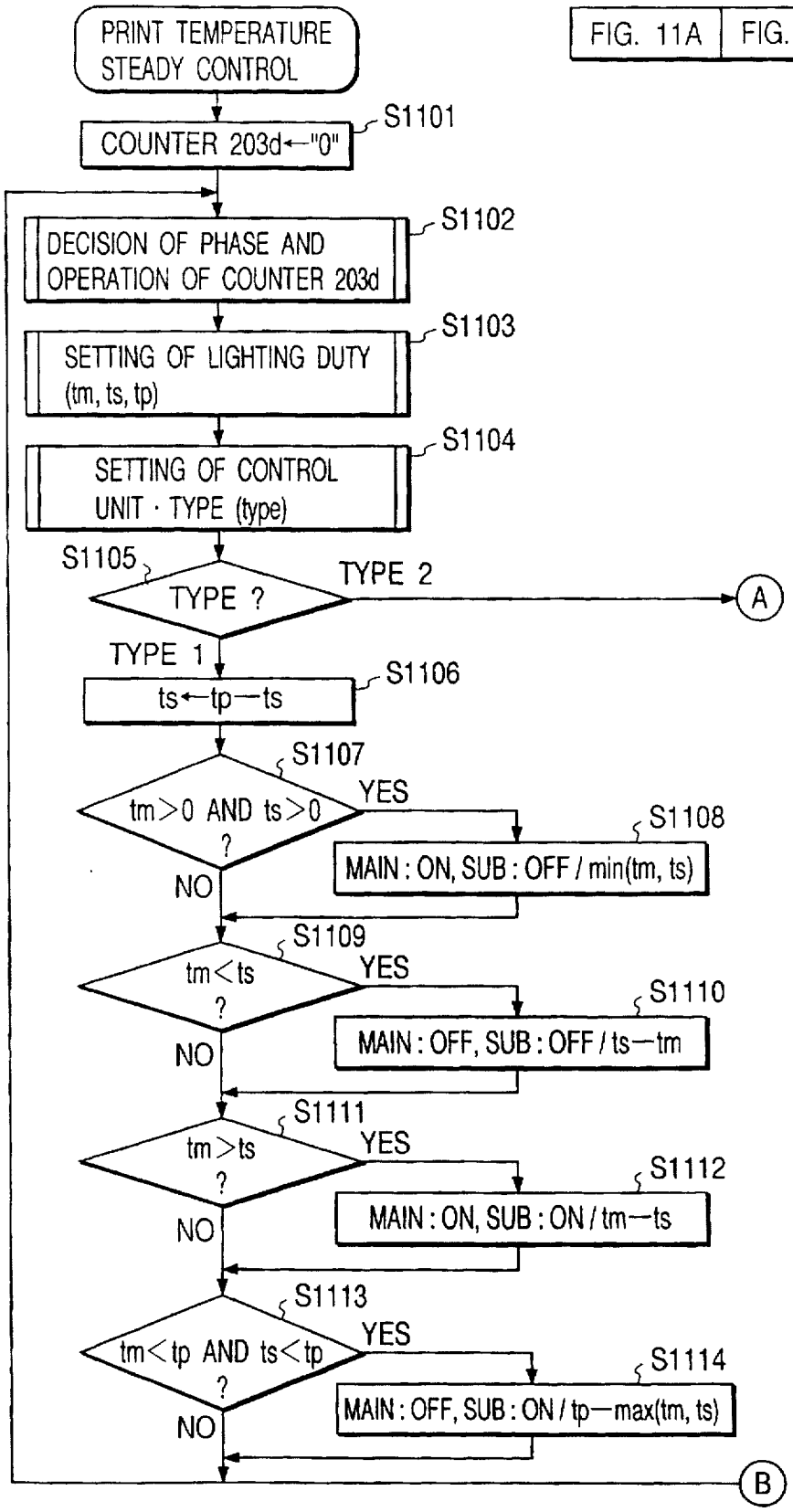
FIG. 11 which is composed of FIGS. 11A and 11B shows a flow chart illustrating a process of the print temperature steady control in the Embodiment 1 of the present invention.
Figure 11B:
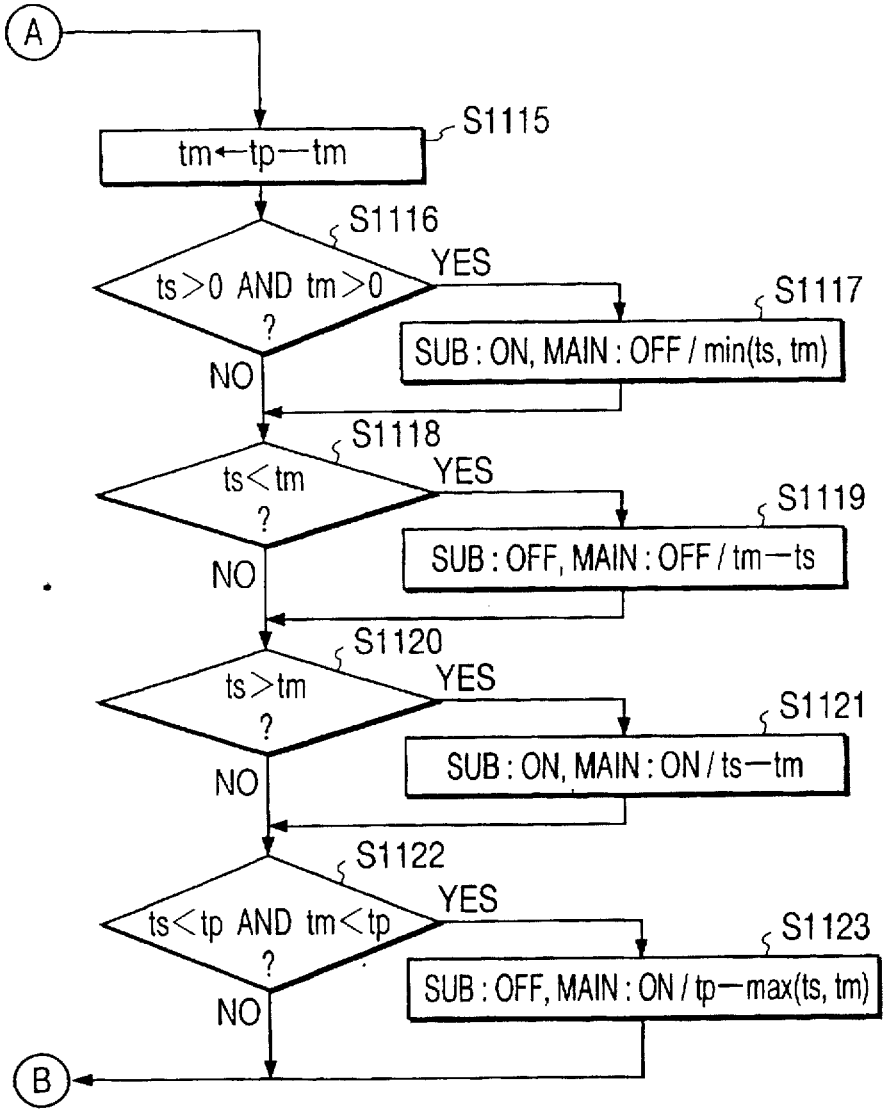

FIGS. 11A and 11B show flow charts of a process to control to a steady state after the rise of the fixing roller temperature in the print mode.

In the present embodiment, the following settings are made:

Target temperature: print temperature (190° C. or 195° C.)

Hysteresis: 2° C.

First, the counter 203*d* for counting the number of heater control units is cleared to "0" (step S1101)

Then, as shown in FIG. 13, the shift of the phase and the operation of the counter 203*d* are conducted in accordance with the current phase and the thermistor temperature (step S1102).

FIG. 12A shows lengths of tm and ts in the temperature steady control. Groups 1 to 4 denote sheet size groups shown in FIG. 12B. Duty No. changes with the count of the control units and 15 is set at t eh start of the control. A column To Group indicates a changed value of the Duty No. when the group of the sheet to be used is changed from other than 3 to 3. A column From Group indicates a changed value of the Duty No. when the group of sheet to be used is changed from 3 to other than 3.

In FIG. 12B, "-P" indicates portrait and "-L" indicates landscape.

Then, the main-sub-heater turn-on duties tm/ts and the heater control unit period tp are determined in accordance with the following process (1) and FIGS. 12A and 12B.

[Process 1]

M, S and P of the following control units (M, S and P) indicate tm, ts and tp, respectively. In the present process, M and S follow the values shown in FIGS. 12A and 12B.

Phase F: control unit (M, S, 500 ms)

Phase L: control unit (M, S, 500 ms)

Figure 14:
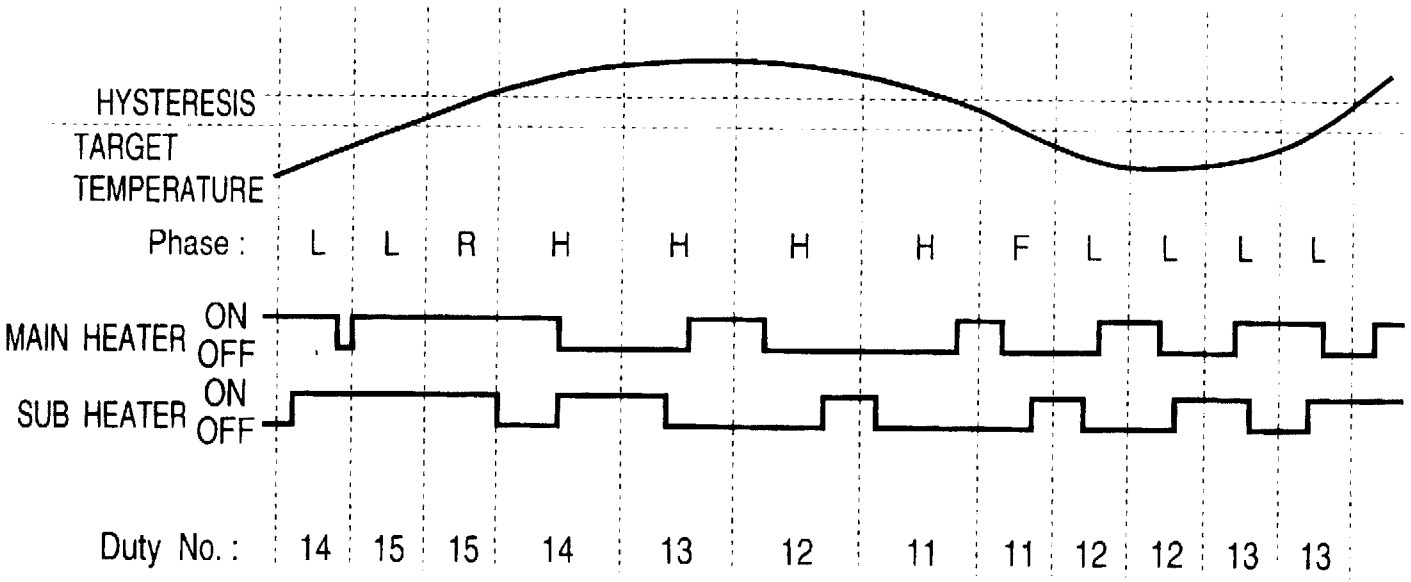
FIG. 14 shows a time chart of an overall print temperature steady control in the Embodiment 1 of the present invention.

For the above two phases, the Duty No. is incremented at each shift from other phase to the Phase L or each time when the control unit is counted by two (FIG. 14).

The count of the counter 203*d* is reset at the shift from other phase to the Phase L.

Phase R: control unit (M, S, 500 ms)

Phase H: control unit (M, S, 800 ms)

For the above two phases, the Duty No. is decremented at the shift from other phase to the Phase H or each time the control unit is counted by one (FIG. 14).

The count of the counter 203*d* is reset at the shift from other phase to the Phase H.

The process 1 is conducted in the manner described above.

A step S1104 is now described.

When the control unit is to be continued, the type of the next control unit is selected in accordance with the turn-on duties of the heater at the end of the previous control unit and the next control unit, respectively. When a timing of the next control unit to change from the turn-on to the turn-off of the heater is close, the duty of each heater remains unchanged and the next control unit period is extended.

Specifically, the selection of the type and the extension of the control unit period are made in accordance with the following rule.

1) When both heaters are off at the end of the previous control unit:

The next control unit period tp, the main heater turn-on time tm and the sub-heater turn-on time ts are considered in the following order and the type is determined by a corresponding condition.

1-1) Main heater turn-on time is 0 ms: Type 1

1-2) Sub-heater turn-on time is 0 ms: Type 2

1-3) Difference between main heater turn-on time and control unit period is not smaller than 100 ms: Type 2

1-4) Difference between sub-heater turn-on time and control unit period is no smaller than 100 ms: Type 1

1-5) Other than above: Type 1

Control unit period is extended by 100 ms.

2) When the main heater is off and the sub-heater is on at the end of the previous control unit: Type 2

3) When the main heater is on and the sub-heater is off at the end of the previous control unit: Type 1

4) When both heaters are on at the end of the previous control unit:

4-1) Main heater turn-on time is equal to 0 ms or control unit period: Type 2

4-2) Other than above: Type 1

In this manner, the process of the step S1104 is conducted.

Since the data tm, ts, tp and type necessary for the temperature control have been settled in the above steps, the process shifts to the duty control.

In a step S1105, the type is determined. The following description applies when the Type 1 is determined.

For the convenience of the process, ts is set to the sub-heater turn-off time in the control unit (step S1106).

If neither tm nor ts is 0 ms (step S1107), the main heater is turned on and the sub-heater is turned on for only a shorter one of the times (step S1108).

If tm is shorter than ts (step S1109), both the main heater and the sub-heater are turned on for a time corresponding to the difference (step S1110).

If tm is longer than ts (step S1111), both the main heater and the sub-heater are turned on for a time corresponding to the difference (step S1112).

If both tm and ts are shorter than tp (step S1113), the main heater is turned off and the sub-heater is turned on for a time corresponding to the difference between a longer one of tm and ts, and tp (step S1114).

If Type 2 is determined in the step S1105, the control in which the positions of the main heater and the sub-heater are completely reversed is conducted in the steps S1106 to S1114 (steps S1115 to S1123).

An overall time chart of the print temperature steady control conducted in the above process is shown in FIG. 14.

[Embodiment 2]

The Embodiment 1 described above has a drawback in that when the Duty No. is too much decremented in the Phase H, it is difficult to return to a desired value in the Phase L. FIGS. 12A and 12B show data under the use of a printer in a normal state but when the fixing roller reaches a high temperature by an error factor, it is not possible in the Embodiment 1 to make the turn-on time to completely 0 ms and the fixing roller temperature might be further raised to a dangerous temperature. Accordingly, in the present embodiment, when the temperature reaches the target temperature +5° C., the turn-on time is made completely 0 ms. In this case, the decrementing is not conducted to prevent the Duty No. from becoming too small (FIG. 15).

Figure 16:
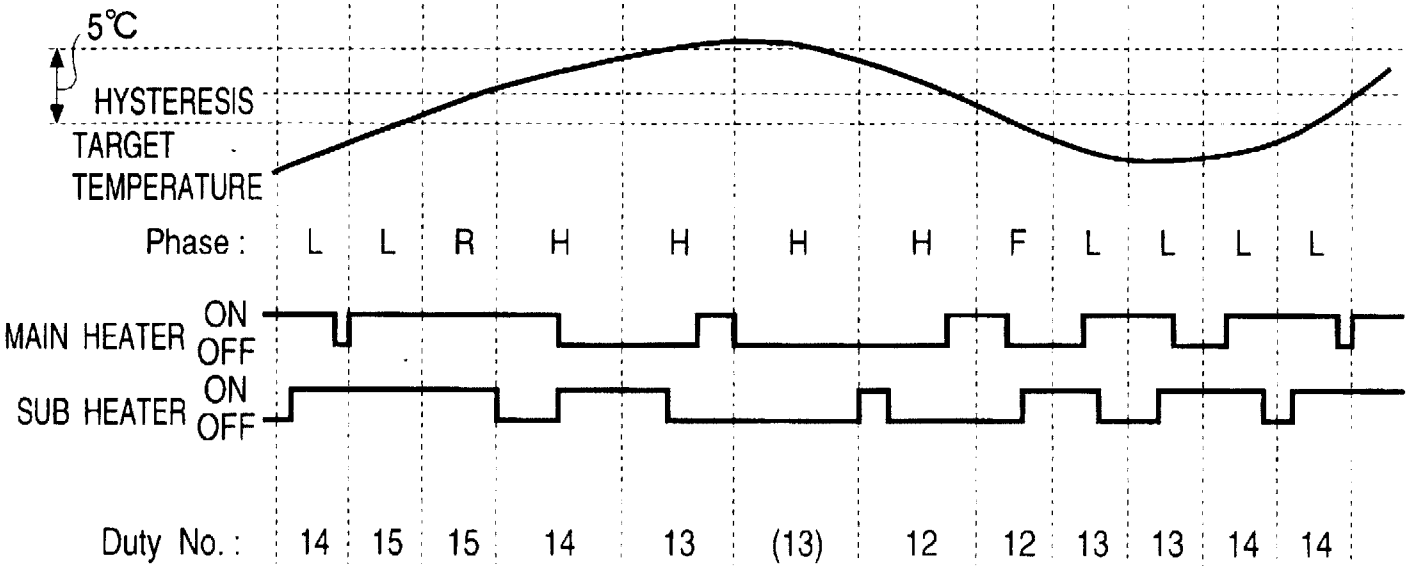
FIG. 16 shows a time chart of an overall print temperature steady control in the Embodiment 2 of the present invention.

An overall time chart of the temperature steady control in the Embodiment 2 is shown in FIG. 16.

[Embodiment 3]

The fault detection of the heater circuit is now explained.

Figure 3:
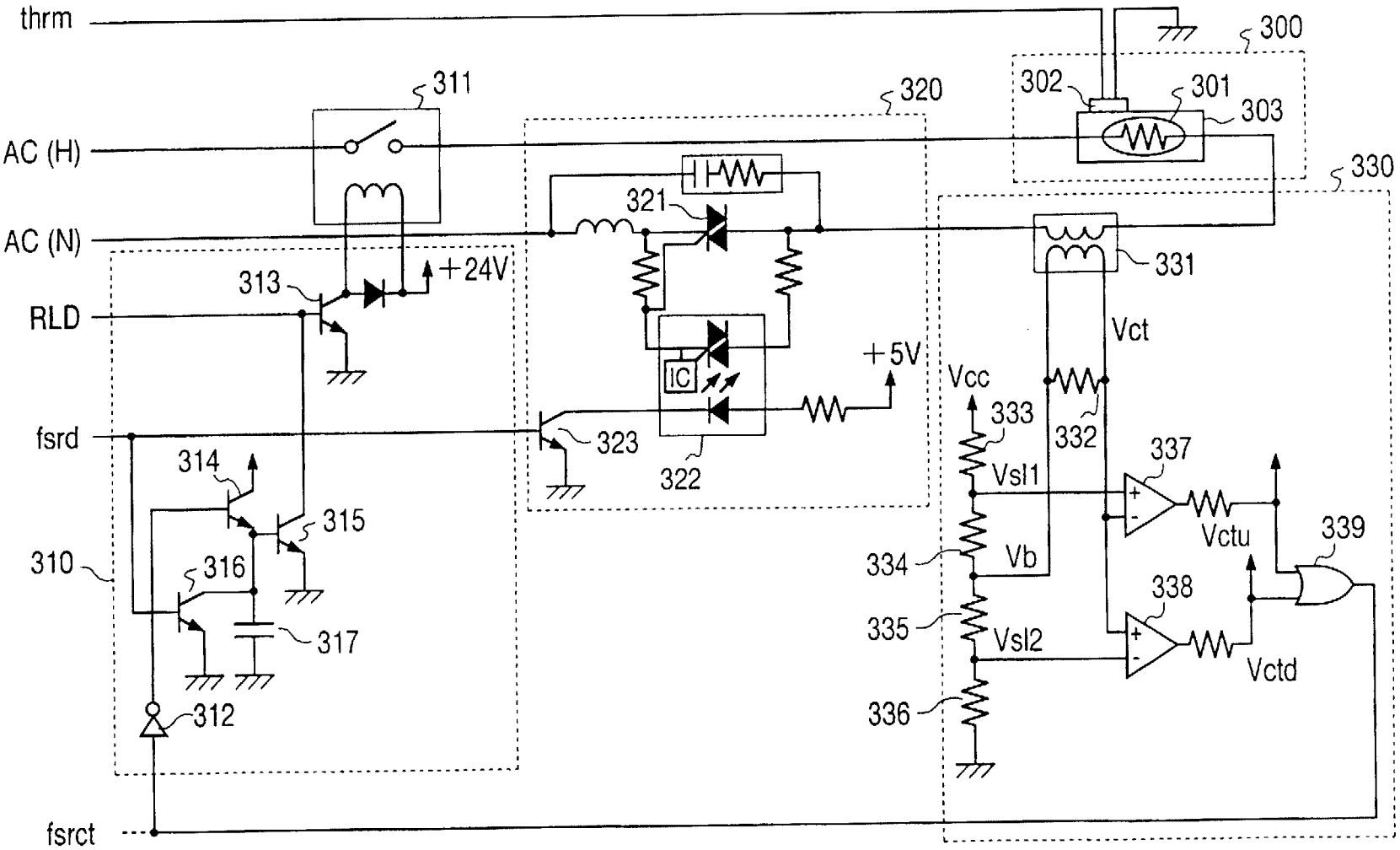
FIG. 3 shows a circuit diagram of a configuration of a current detection circuit of single heating source in accordance with an Embodiment 3 of the present invention.

FIG. 3 shows a block diagram of a basic portion of a current detection circuit of a heating source. Numeral 300 denotes a fixing unit, numeral 301 denotes a halogen heater, numeral 302 denotes a thermistor, numeral 303 denotes a fixing roller, numeral 310 denotes a relay drive/protect circuit, numeral 320 denotes a turn-on circuit and numeral 330 denotes a current detection, detection signal generation circuit for detecting an energization state.

Figure 4:
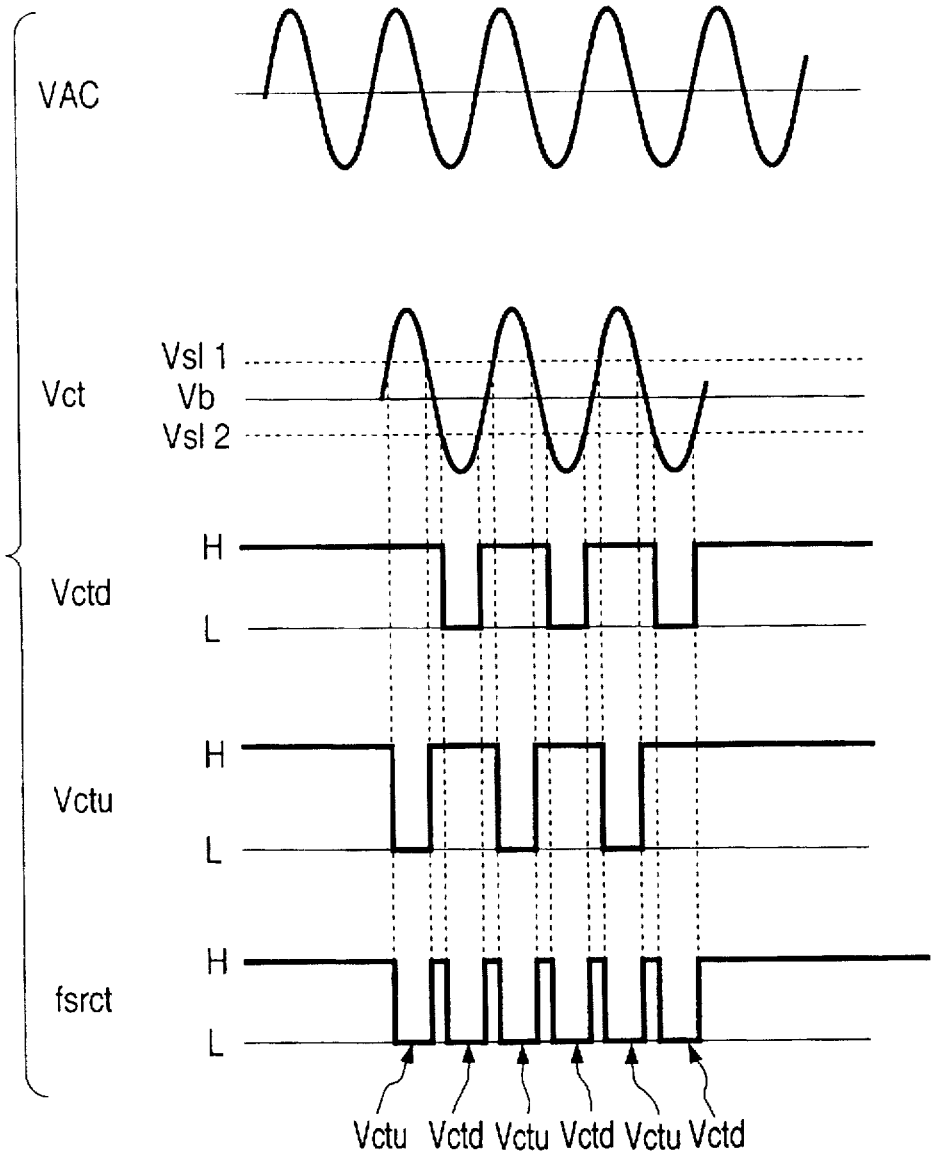
FIG. 4 shows waveforms of various points in FIG. 3.

FIG. 4 shows waveforms of signals and generated voltages at various points of the current detection/detection signal generation circuit 330.

A relay drive signal RLD is rendered TRUE to turn on the relay 311, and a heater drive signal fsrd is rendered TRUE to turn on a triac 321 to turn on the halogen heater 301. A voltage Vct generated across a resistor 332 in a secondary circuit of a current transformer 331 exhibits a voltage waveform which is analogous to an AC voltage, around a voltage Vb.

Voltage-signals Vctu and Vctd are generated from comparators 337 and 338, respectively, by voltages Vsl1 and Vsl2 divided by resistors 333, 334, 335 and 336. The signals Vctd and Vctu are combined by an OR gate 339 to output a signal fsrct.

In the circuit of FIG. 3, the heater current detection signal fsrct is used as an activation signal of a protection circuit at the short-circuit fault of the triac. As shown by the relay drive/protection circuit 310 of FIG. 3, the protection circuit inverts the heater current detection signal fsrct to turn on a transistor 314 at the energization of the halogen heater 301, charge a capacitor 317, turn on a transistor 315 and turn off a transistor 313 to turn off a relay 311.

When the heater drive signal fsrd is TRUE, a transistor 316 is turned on and a capacitor 317 is not charged to keep the relay 311 in the on state, and when the heater drive signal fsrd is FALSE, the relay 311 is turned off when the heater current detection signal fsrct is FALSE to keep the security of the triac 321 in the short-circuit fault.

When a plurality of halogen heaters are provided, a plurality of such circuits and heater current detection signals fsrct are required. The heater current detection signals fsrct are inputted to a CPU (microcomputer), not shown. When the heater drive signal fsrd is TRUE and the relay drive signal RLD is TRUE and the current detection signal fsrct is TRUE, the open circuit fault of the triac 321 or the heater 301 is determined.

Figure 5:
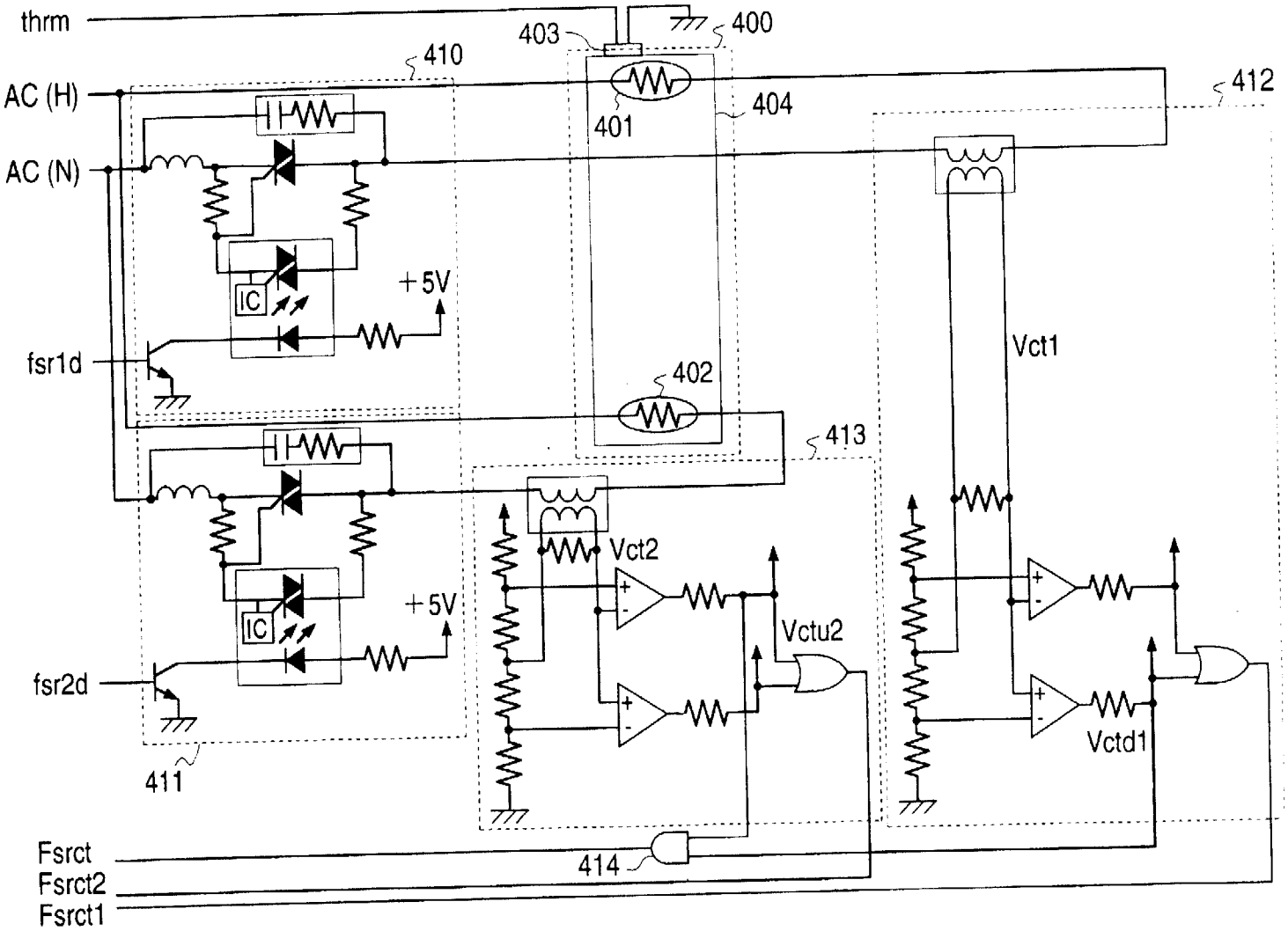
FIG. 5 shows a circuit diagram of a configuration of a current detection circuit of two heating sources in accordance with the Embodiment 3 of the present invention.

FIG. 5 shows a configuration of a fault detection unit when a plurality (two) of halogen heaters are provided. Numeral 400 denotes a fixing unit, numerals 401 and 402 denote heaters, numeral 403 denotes a thermistor, numeral 404 denotes a fixing roller, numerals 410 and 411 denote heater drive circuits and numerals 412 and 413 denote current detection/detection signal generation circuits.

Figure 6:
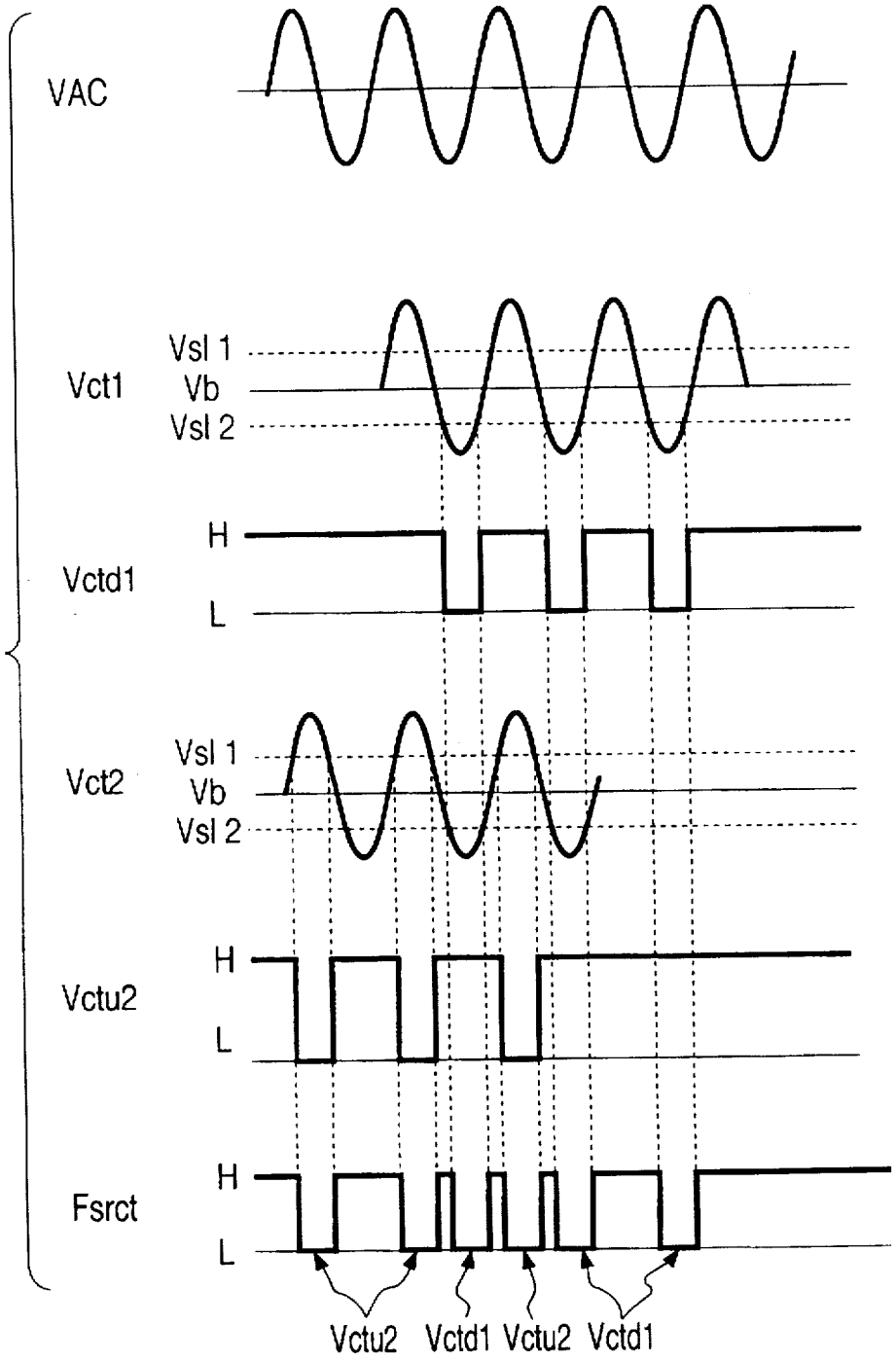
FIG. 6 shows waveforms at various points in FIG. 5.

FIG. 6 shows waveforms at various points in the circuit of FIG. 5.

Figure 19A:
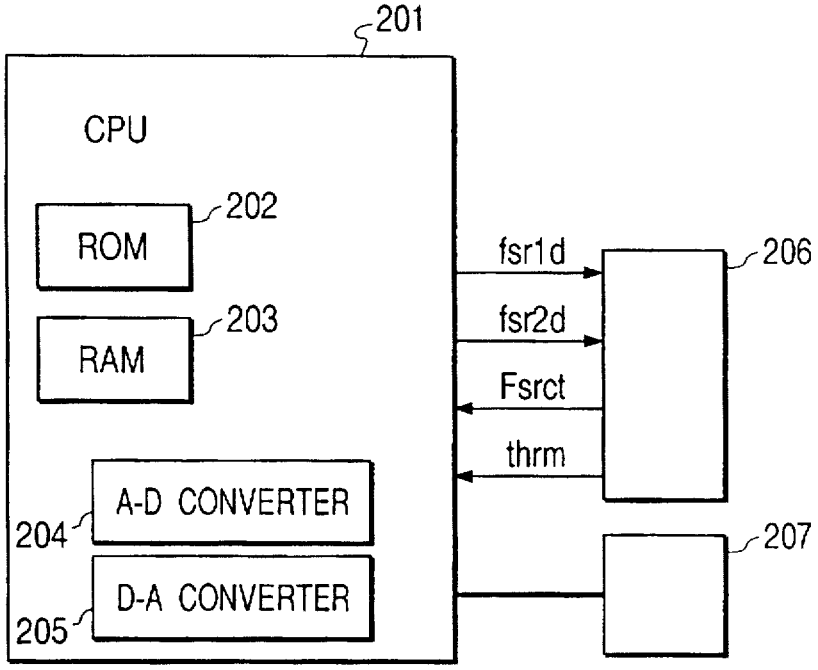
FIGS. 19A and 19B show block diagrams of a configuration of an electrical circuit of the printer in accordance with the Embodiment 3 of the present invention.
Figure 19B:
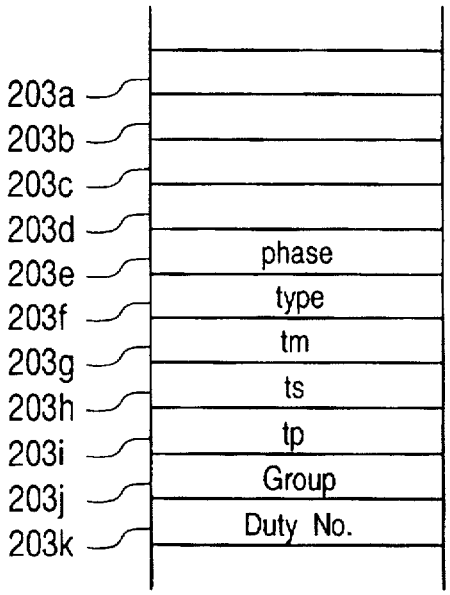

A signal Vctd1 generated when it is not higher than a voltage Vsl2 for detecting that it is lower than a reference voltage Vb of an output waveform of a current transformer during the energization of the heater 401 and a signal Vctu2 generated when it is not lower than a voltage Vsl1 for indicating that it is higher than the reference voltage Vb of the output waveform of the current transformer during the energization of the heater 402 are combined by an AND circuit 414. Thus, the two heater current detection signals fsrct1 and fsrct2 are combined into one signal Fsrct so that the signal transmission to the CPU (microprocessor) is attained without increasing the transmission paths to the CPU. (See FIGS. 19A and 19B. FIGS. 19A and 19B are identical to FIGS. 2A and 2B except Fsrct.) Pulses of the current detection signals Fsrct for the heaters 401 and 402 do not overlap even if the two heaters are simultaneously turned on. By using the current detection signal Fsrct and the heater drive signals fsr1*d* and fsr2*d*, the determination of the heater by the CPU and the detection of the fault (break) thereof are attained.

Figure 7:
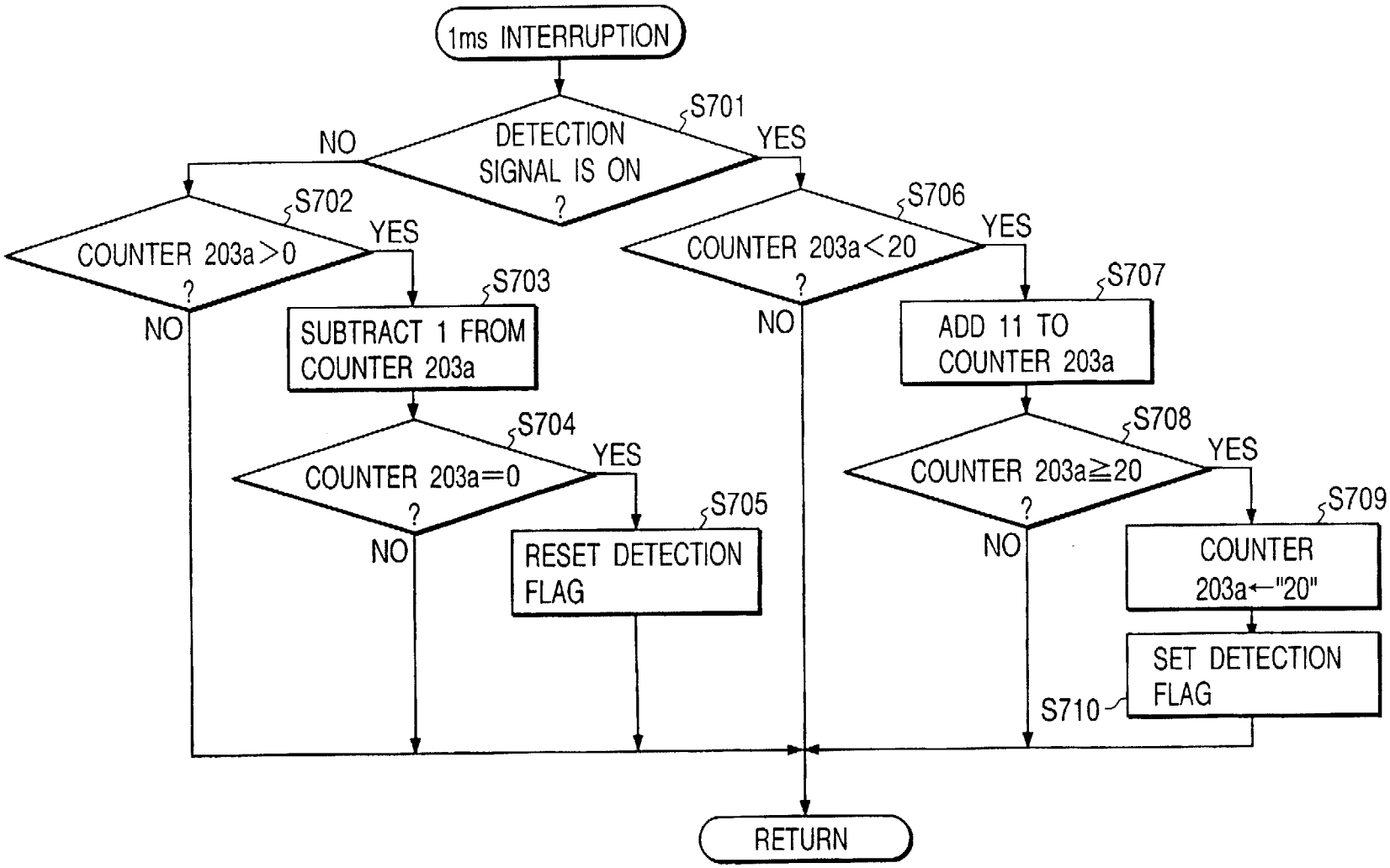
FIG. 7 shows a flow chart of a process to detect an energization status of a heater in accordance with the present invention.
Figure 8:
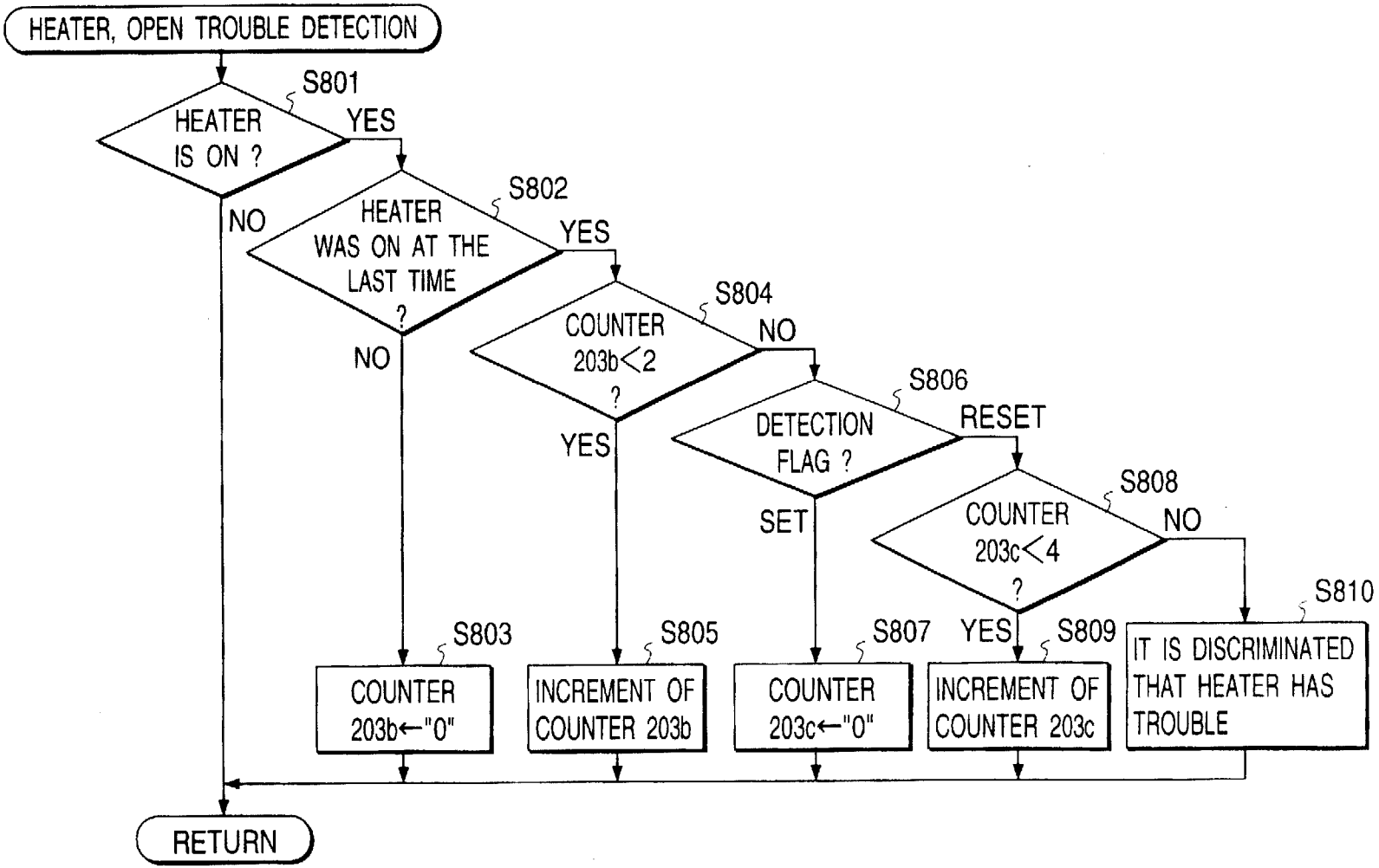
FIG. 8 shows a flow chart of a process to detect a heater break in accordance with the present invention.

FIGS. 7 and 8 show flow charts of a process of the heater fault detection.

A program shown in FIG. 7 is started at a 1 ms interval and it is an interruption routine to detect the heater energization status.

First, in a step S701, whether the current detection signal Fsrct is on or not is determined. If the detection signal Fsrct is off, the process proceeds to a step S702. If the detection signal Fsrct is on, the process proceeds to a step S706.

In the step S702, whether a count of the counter 203*a* is larger than 0 or not is determined. If the count of the counter 203*a* is not larger than 0, the process returns from the routine. If the count of the counter 203*a* is larger than 0, the process proceeds to a step S703 to decrement the counter 203*a* by one, and the process proceeds to a step S704.

In the step S704, whether the count of the counter 203*a* is 0 or not is determined. If the count of the counter 203*a* is not 0, the process returns from the routine. If the count of the counter 203*a* is 0, a detection flag (fl_ht_crtn), not shown, is reset and the process returns from the routine.

In a step S706, whether the count of the counter 203*a* is smaller than 20 or not is determined. If the count of the counter 203*a* is not smaller than 20, the process returns from the routine. If the count of the counter 203*a* is smaller than 20, the process proceeds to a step S707 to add 11 to the counter 203*a*, and the process proceeds to a step S708.

In the step S708, whether the count of the counter 203*a* is not smaller than 20 or not is determined. If the count of the counter 203*a* is smaller than 20, the process returns from the routine. If the count of the counter 203*a* is not smaller than 20, the process proceeds to a step S709 to set the counter 203*a* to 20, and the process proceeds to a step S710 to set the detection flag. Then, the process returns from the routine.

The above description is further supplemented as follows.

Usually, in a fault diagnose algorithm, a fault should be positively detected but no misdetection is desired.

Thus, in the present invention, the energization is not directly relied on but the settlement of the on/off state of the energization signal is assumed when the on/off state of the energization signal lasts for a predetermined time period. The elapse of the predetermined time period is counted by the counter 203*a*. It is the detection flag that indicates the settlement of the on/off state of the energization signal.

When the detection flag is hard to be reset, the misdetection occurs more hardly. Accordingly, the increment/decrement of the counter 203*a* is set at a rate of 1 msec.

A time for the detection flag to change from TRUE to FALSE is set to 20 msec, and a time to change from FALSE to TRUE is set to 2 msec. Thus;

TRUE→FALSE: decrement counter 203*a* by one for each interruption

FALSE→TRUE: increment counter 203*a* by one for each interruption In order to meet the above condition, un upper limit of the count is set to 20 and an increment is set to 11.

The flow chart of FIG. 8 is started at a 15 ms interval and it is a routine to detect a heater fault. In a step S801, whether the heater is on or not is determined. If the heater is off, the process returns from the routine. If the heater is on, the process proceeds to a step S802.

In the step S802, whether the heater was on previously or not is determined. If it was not on previously, the process proceeds to a step S803 to set the counter 203*b* to 0 and the process returns from the routine. If the heater was on previously, the process proceeds to a step S804.

In the step S804, whether the count of the counter 203*b* is smaller than 2 or not is determined. If the count of the counter 203*b* is smaller than 2, the process proceeds to a step S805 to increment the counter 203*b* by one and the process returns from the routine. If the count of the counter 203*b* is not smaller than 2, the process proceeds to a step S806.

In the step S806, whether the detection flag (fl_ht_crtn) operated by the program shown in FIG. 7 is set or reset is determined. If the detection flag is set, the process proceeds to a step S807 to set the counter 203*c* to 0 and the process returns from the routine. If the detection flag is not set, the process proceeds to a step S808.

In the step S808, whether the count of the counter 203*c* is smaller than 4 or not is determined. If the count of the counter 203*c* is smaller than 4, the process proceeds to a step S809 to increment the counter 203*c* by one and the process returns from the routine. If the count of the counter 203*c* is not smaller than 4, the process proceeds to a step S810 to determine as the heater fault.

The heater fault (break) is determined by the process shown in the flow charts of FIGS. 7 and 8.

Figure 17:
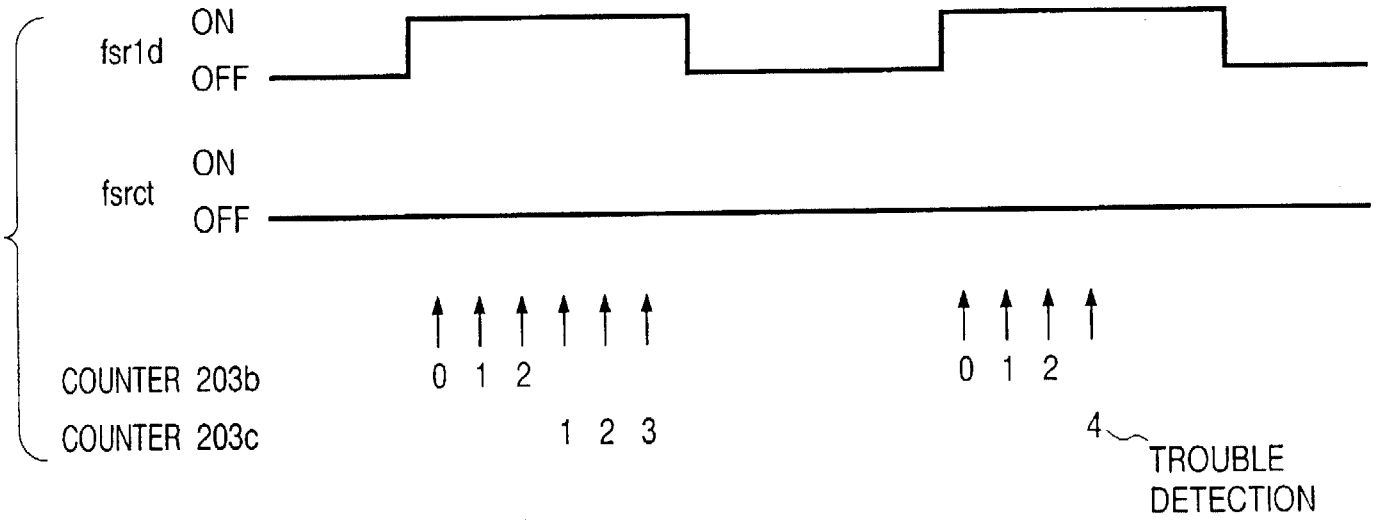
FIG. 17 shows a time chart illustrating a manner of the detection of the break of a fixing heater in the Embodiment 3 of the present invention.
Figure 18:
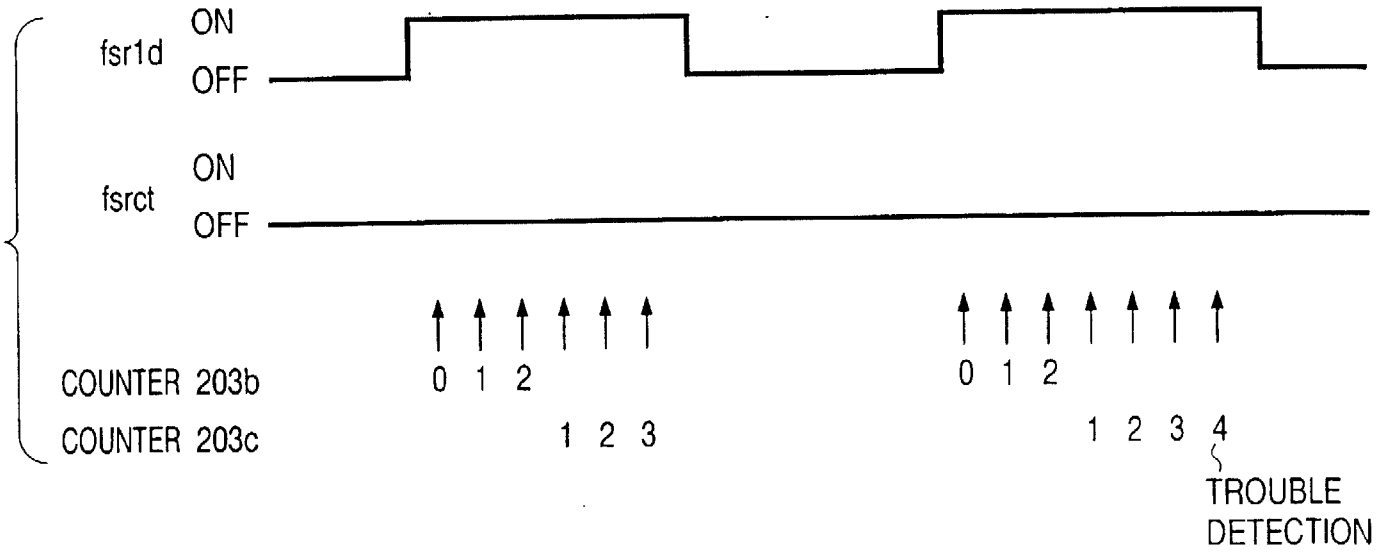
FIG. 18 shows a time chart illustrating a manner of the detection of the break of the fixing heater in a prior art device.

FIG. 17 shows a time chart of the fault detection by the process shown in the flow charts of FIGS. 7 and 8. For example, when the heater is on (fsrld: on) and the energization detection signal is not generated (fsrct: off), the counter 203*b* counts 0, 1, 2 and when the count of the counter 203*b* reaches 2, the counter 203*c* counts 1, 2, 3, and even if the heater is turned off, the current count is stored and when the heater is turned on next time, the counter 203*b* again counts 0, 1, 2 and the counter 203*c* counts from the count next to the previously stored count. Namely, it counts 4 to detect the fault.

In this manner, the fault can be positively detected even if the duty control with a short continuous turn-on time of the heater is conducted.

The present invention offers the following effects.

Since the fixing heater control is conducted at a short time interval and the turn-on duty is variable, a proper heater supply power to control to the target temperature can be applied in a short period. As a result, the temperature ripple is reduced very much.

Further, for the fault of the type which cannot be detected unless the fault state continues for certain period, the counter to continuously store the fault state is provided so that such fault can be positively detected.

Further, when a plurality of heating sources (for example, halogen heaters) are provided, means for combining the detection signals of the drive currents of the respective heaters into one signal is provided to reduce the number of signals while allowing the discrimination of the heaters so that the complication of the transmission paths and the cost increase are suppressed.

What is claimed is:

1. A heating control apparatus comprising:

temperature control means for controlling a driving time of a load in each cycle for each predetermined minute cycle to keep a temperature of the load for heating in a target temperature;

count means for counting a time during which the drive of said load is abnormal in one cycle and maintaining the count until a next one cycle; and discrimination means for determining that said load is abnormal overall when a sum of the count of said count means in said one cycle and the count of said count means in the next one cycle reaches a predetermined values, wherein the driving time of the load by said temperature control means can be made shorter than time corresponding to the predetermined value.

2. An apparatus according to claim 1 wherein said load is a heater of a thermal fixing unit.

3. A heating control apparatus comprising:

switching means for controlling a power supplying time to a load in each cycle for each predetermined minute cycle;

input means for inputting a control signal to activate said switching means;

detection means for detecting a current flowing through said load;

count means for counting a time during which a current is not detected continuously by said detection means in one cycle while said control signal is inputted to said input means; and discrimination means for determining that said load is abnormal overall when a sum of the count of said count means in one cycle and the count of said count means in next one cycle reaches a predetermined values, wherein the power supplying time by said switching means can be made shorter than a time corresponding to the predetermined value.

4. An apparatus according to claim 3 wherein said load is a heater of a thermal fixing unit.

5. An apparatus according to claim 1. wherein said temperature control means has temperature detecting means for detecting the temperature of the load and wherein said temperature control means changes a length of one cycle according to the detected temperature.

* * * * *

UNITED STATES PATENT AND TRADEMARK OFFICE

CERTIFICATE OF CORRECTION

PATENT NO. : 5,756,969

DATED : May 26, 1998

INVENTOR(S) : Hitoshi MACHINO, et al.

It is certified that error appears in the above-identified patent and that said Letters Patent is hereby corrected as shown below:

COLUMN 1:

Line 63, "other" should read --another--.

COLUMN 2:

Line 1, "other" should read --another--.

COLUMN 3:

Line 7, "Numeral 105" should read --Numeral 105 denotes--;
Line 34, "other" should read --another--; and
Line 45, "controlls" should read --controls--.

COLUMN 4:

Line 17, "t eh" should read --the--.

COLUMN 8:

Line 64, "values," should read --value,--.

UNITED STATES PATENT AND TRADEMARK OFFICE

CERTIFICATE OF CORRECTION

PATENT NO. : 5,756,969 Page 2 of 2

DATED : May 26, 1998

INVENTOR(S) : Hitoshi MACHINO, et al.

It is certified that error appears in the above-identified patent and that said Letters Patent is hereby corrected as shown below:

COLUMN 10:

Line 2, "next" should read --the next--, and "values," should read --value,--.

Signed and Sealed this

Tenth Day of August, 1999

*Attest:*

Q. TODD DICKINSON

*Attesting Officer*

*Acting Commissioner of Patents and Trademarks*